US005799360A

United States Patent [19]

Vosbikian

[11] Patent Number: 5,799,360

[45] Date of Patent: Sep. 1, 1998

[54] COMBINED BROOM AND DUSTPAN

[75] Inventor: John Vosbikian, Medford, N.J.

[73] Assignee: Big Ideas, L.L.C., Moorestown, N.J.

[21] Appl. No.: 921,226

[22] Filed: Aug. 27, 1997

[51] Int. Cl.[6] ..... A47L 13/52

[52] U.S. Cl. ..... 15/257.2; 15/159.1; 15/171; 15/257.1; 15/257.8

[58] Field of Search ..... 15/105, 104.8, 15/159.1, 171, 175, 257.1–257.9; D32/42, 50, 77

[56] References Cited

U.S. PATENT DOCUMENTS

| | | | |
|---|---|---|---|
| 452,358 | 5/1891 | Bishop | 15/257.2 |
| 468,433 | 2/1892 | Bishop | 15/257.7 X |
| 637,908 | 11/1899 | Vroman | 15/257.1 |
| 1,375,017 | 4/1921 | Russell | 15/257.5 X |
| 1,990,026 | 2/1935 | Glen, Jr. | 15/257.6 |
| 2,782,615 | 2/1957 | Johnson | 15/257.1 |
| 2,849,743 | 9/1958 | McFarland | 15/257.2 |
| 3,029,455 | 4/1962 | Siculan | 15/159.1 |
| 3,082,455 | 3/1963 | Evancha | 15/105 |
| 3,278,969 | 10/1966 | Wenzfaff et al. | 15/257.7 |
| 5,661,868 | 9/1997 | Panagakos et al. | 15/257.2 X |

*Primary Examiner*—Mark Spisich
*Attorney, Agent, or Firm*—Norman E. Lehrer

[57] ABSTRACT

A broom and dustpan combination where the broom includes an elongated handle, a body of straw-like members, and a holder in which a dustpan may be releasably retained is disclosed. The dust pan is foldable about a hinge member and is held within the holder by a locking member. A spring biases the dustpan into its open position and a pair of feet hold the bottom back of the dustpan upwardly so that debris can be swept into the same.

8 Claims, 2 Drawing Sheets

COMBINED BROOM AND DUSTPAN

BACKGROUND OF THE INVENTION

The present invention is directed toward a combined broom and dustpan and more particularly, toward a foldable dustpan which is slidably received within a holder of a broom.

Dustpans are frequently used in conjunction with brooms in order to effectively remove dust and debris that have been swept into a pile. While the dustpan and the broom are usually stored in the same location, it is not uncommon for one or the other to be misplaced.

There are several broom and dustpan combinations described in prior patents where the dustpan is secured to the broom. For example, U.S. Pat. No. 1,990,026 to Glen, Jr. teaches a dustpan secured to a broom via a container which is removably connected to the broom handle. This combination, however, requires several parts and the container is not permanently affixed to the broom handle.

U.S. Pat. No. 3,029,455 to Siculan discloses a dustpan with a clip which is received in a slot in the hood member of a broom so that the dustpan is secured to the broom. U.S. Pat. No. 2,849,743 to McFarland discloses a collapsible dust pan attachment where a foldable dustpan is connected to a handle and the handle is connected to a broom handle. U.S. Pat. No. 3,082,455 to Evancha discloses a dustpan with a trough-shaped handle which frictionally engages the handle of a broom.

None of these patents, however, discloses the combination of a foldable dustpan and broom where the dustpan fits into a recess of a holder on a broom and where the holder is formed as part of the broom. That is, the above-mentioned patents disclose a container or holder which is a separate unit that is attached to the broom. The construction of the present invention allows for compactly and conveniently storing a dustpan when it is not being used and provides for the holder to be formed as a part of the broom.

SUMMARY OF THE INVENTION

The present invention is designed to overcome the deficiencies of the prior art discussed above. It is an object of the present invention to provide a combined broom and dustpan which is relatively inexpensive to manufacture.

Another object of the invention is to provide a broom and dustpan combination where the dustpan fits securely within a holder on a broom.

It is a further object of the invention to provide a broom and dustpan combination that includes a foldable dustpan.

In accordance with the illustrative embodiments, demonstrating features and advantages of the present invention, there is provided a combined broom and dustpan combination where the broom includes an elongated handle and a holder in which a foldable dustpan may be held.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
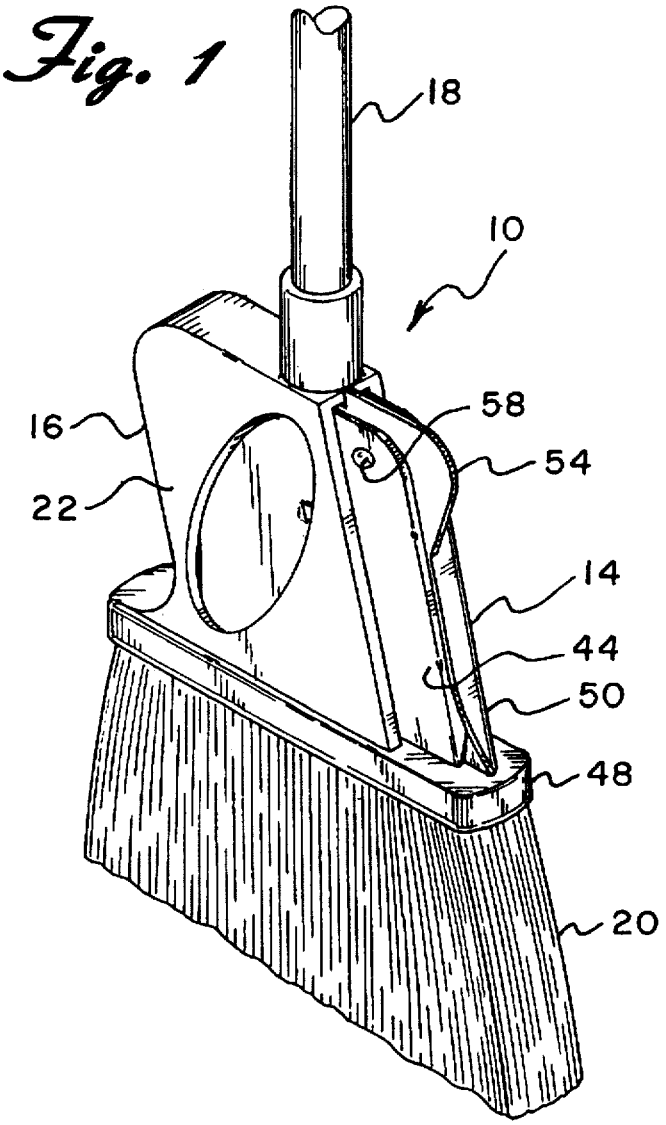
FIG. 1 is a front perspective view of the combined broom and dustpan of the present invention.
Figure 2:
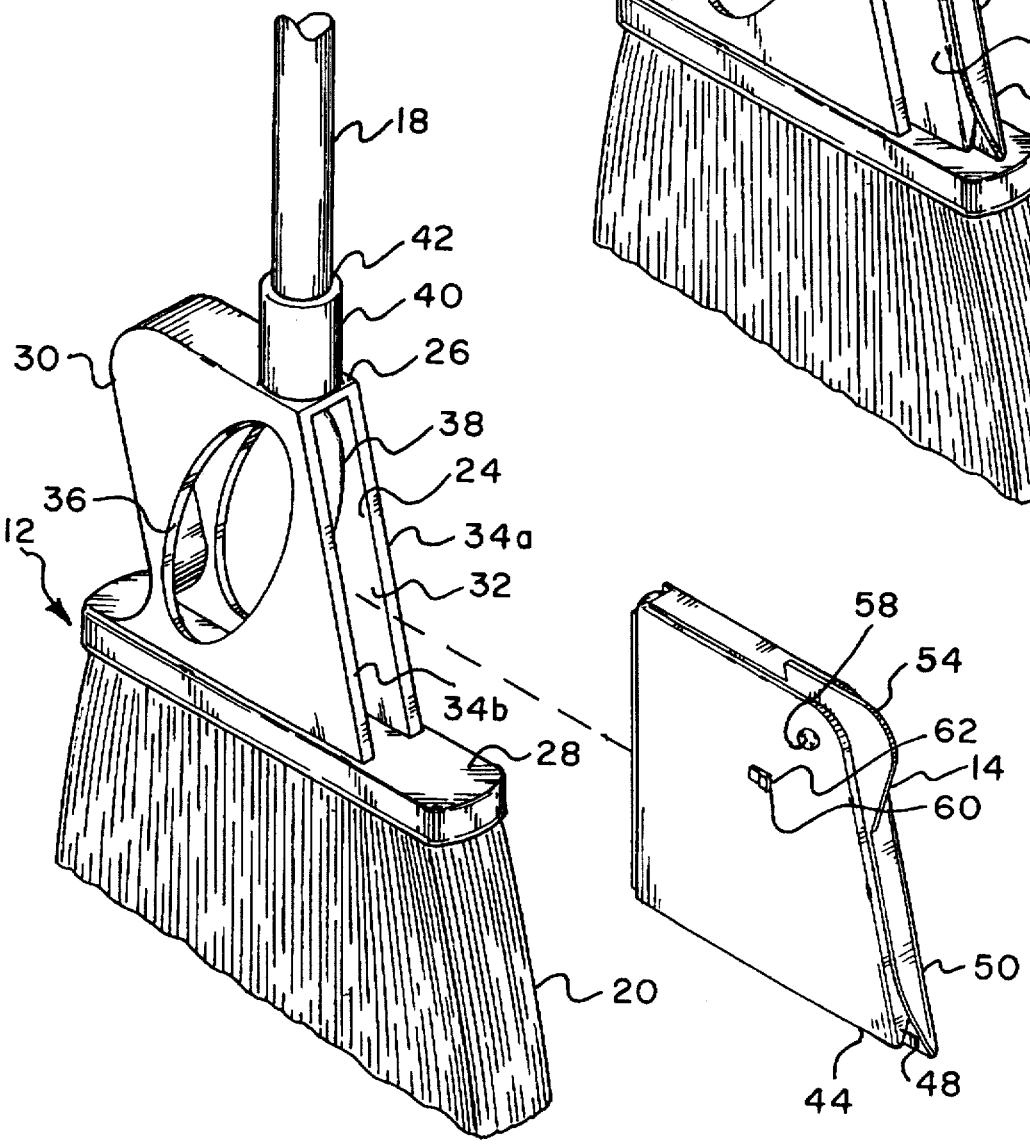
FIG. 2 is an exploded perspective view of the combined broom and dustpan of the present invention.

Referring now to the drawings in detail wherein like reference numerals have been used throughout the various figures to designate like elements, there is shown in FIG. 1 a combined broom and dustpan constructed in accordance with the principles of the present invention and designated generally as 10.

The combined broom and dustpan 10 includes a broom 12, a dustpan 14, and a holder 16 on the broom 12. The broom 12 has an elongated handle 18 and a body 20 of straw-like members. The straw-like members may be made from natural broom straw, plastic, or the like. The body 20 of straw-like members extends downwardly from the bottom of the holder. (See FIG. 1.)

The holder 16 has a front wall 22, a rear wall 24, a top wall 26, a bottom wall 28, a curved sidewall 30, and an opening 32 defined by side edges **34*a* and 34*b* opposite sidewall 30. The front wall 22, rear wall 24, sidewall 30, and side edges 34*a* and 34*b* extend upwardly from the bottom wall 28 and form a generally square housing. A dustpan 14 fits within opening 32. A hole 36 is formed in the front wall 22 and a hole 38 is formed in the rear wall 24. The holes 36 and 38 are centrally located on each wall 22 and 24, respectively. The top wall 26 of the holder 16 has a reinforcing member 40 which is generally cylindrical and extends upwardly, with an opening 42 through which the broom handle 18 fits. The reinforcing member 40 has screw threads (not shown) so that the broom handle may be screwed into place within the opening. While screw threads have been described as the means for attaching the handle to the holder, other means for attaching well known in the art may also be used. The bottom wall 28 of the holder 16** is generally rectangular and has a plurality of holes formed in the bottom thereof from which the straw-like members extend. The straw-like members may be stapled into place or otherwise held using well known techniques. The holder may be made from plastic or a variety of other materials.

Figure 4:
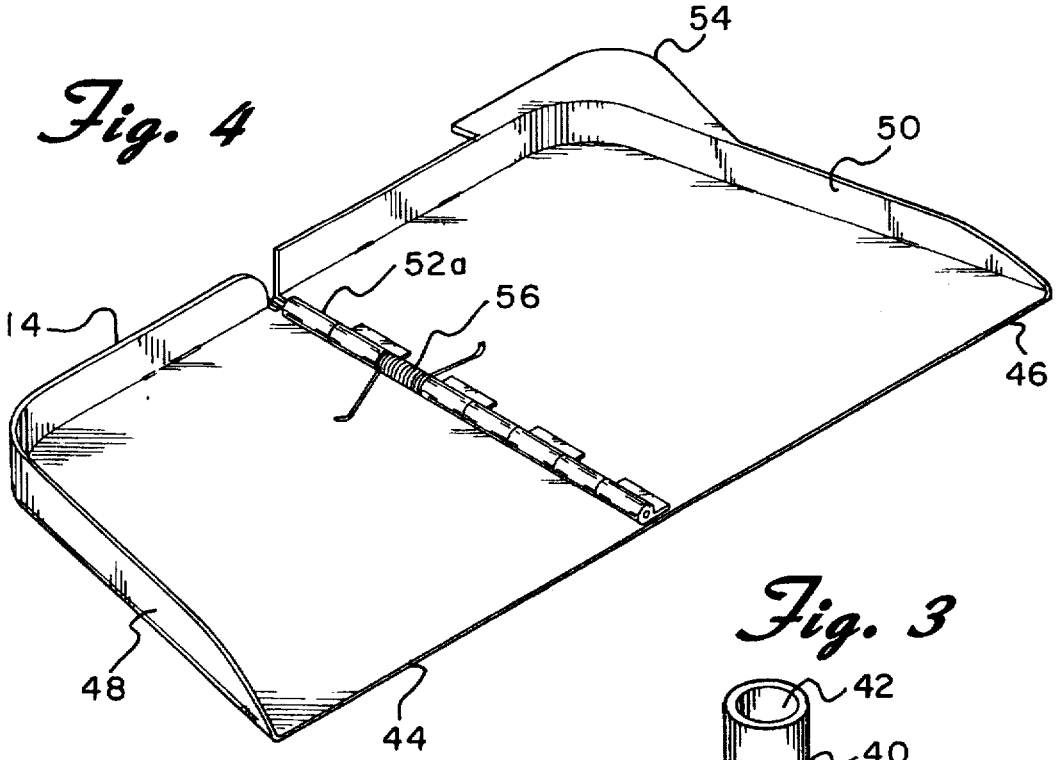
FIG. 4 is a perspective view of the dustpan in an open position.
Figure 3:
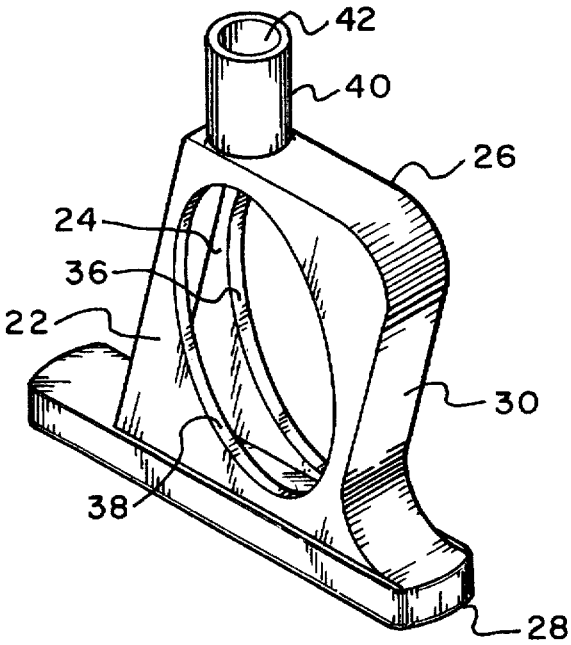
FIG. 3 is a perspective view of the dustpan holder.

The dustpan 14 includes a first panel 44 and a second, slightly larger panel 46 and may be made from plastic or a wide variety of other materials. Each panel has a top, a bottom, and two side edges. Each panel 44 and 46 has a retaining wall 48 and 50, respectively, which extends along the top and one side edge of each of the panels 44 and 46. (See FIG. 4.) The two panels 44 and 46 are connected to one another by hinges, for example, **52*a*, located on the side edges without the retaining walls. Accordingly, the dustpan 14 may be moved from an open position where the panels are substantially side-by-side to a folded position where the first panel 44 folds into the second panel 46. That is, retaining wall 50 of the second panel 46 covers retaining wall 48 of the first panel 44 when the panels are folded. The second panel 46 has a projection 54 with a rounded top extending from the top of its retaining wall 50 which abuts the top edge of top wall 26 of the holder 16 when the dustpan 14 is retained within the holder 16. This projection acts as a stop and limits the movement of the dustpan within the holder. The dustpan 14 also has a spring 56 between the two panels 44 and 46 which biases the dustpan 14 into an open position once it is removed from the holder 16**.

Figure 5:
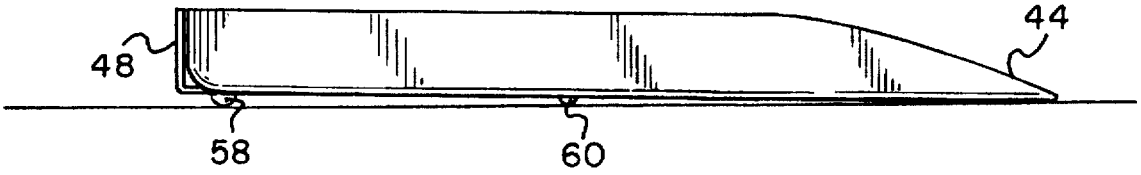
FIG. 5 is a side elevational view of the dustpan.

The back or rear surface of the first panel 44 has a foot 58 so that the dustpan 14, in its open position, will sit at an angle when placed on a surface, as shown in FIG. 5. The foot is a projection extending outwardly from the back of the panel 44 and may be a variety of shapes. A similarly shaped foot (not shown) is also formed on the back of the second panel 46.

Also formed on the back of the first panel 44 is locking member 60 including a leading cam surface 62. The locking member is a projection extending outwardly from the first panel and may be a variety of shapes. When the dustpan 14 is secured within the holder 16, the locking member 60 of the first panel 44 abuts the surface of the front wall 22 which defines hole 36 in the front wall 22 of the holder 16, as seen in FIG. 1, so that the dustpan 14 is secured within the holder 16 and cannot be pulled out.

In order to remove the dustpan from the holder, the first and second panels are squeezed together and pulled outwardly from the holder. This squeezing motion causes the locking member to move away from the surface of the front wall 22, thus enabling the locking member to easily slide behind the front wall. The dustpan may now be completely removed from the holder. Once released from the holder, the dustpan springs to its open position. The user grasps the projection 54 in order to place the dustpan on the surface where dust is to be collected, with the feet resting on the surface. Because of the feet, the dustpan will be slightly raised at an angle from the surface upon which it is placed. The user of the broom may then place his or her foot behind the dustpan in order to steady the dustpan and sweep the dust onto the pan. In this manner, dust may be easily collected. That is, the user maintains both hands on the broom in order to sweep and is not forced to bend over in order to hold the dustpan in its proper position.

The present invention may be embodied in other specific forms without departing from the spirit or essential attributes thereof and accordingly, reference should be made to the appended claims rather than to the foregoing specification as indicating the scope of the invention.

I claim:

1. A broom and dustpan combination comprising:

a foldable dustpan and a broom having an elongated handle, a body of straw-like members, and means for holding said dustpan wherein said means for holding includes a housing with an opening into which said dustpan fits when folded.

2. The broom and dustpan combination of claim 1 wherein said housing has an opening through which said handle fits.

3. The broom and dustpan combination of claim 1 wherein said dustpan has a first panel, a second panel, a spring, and a hinge means for joining said first panel to said second panel so that said panels are movable between an open position, where said panels are substantially side-by-side, to a folded position, wherein said one of said panels overlies the other of said panels.

4. The broom and dustpan combination of claim 3 wherein one of said panels has a retaining means which retains said dustpan within said housing.

5. The broom and dustpan combination of claim 3 wherein at least one of said first and second panels has a foot on a rear surface thereof.

6. The broom and dustpan combination of claim 3 wherein said dustpan has a projection on an edge of one of said panels which abuts an outer surface of said housing.

7. The broom and dustpan combination of claim 1 wherein said housing further includes a front wall, a rear wall, a top, and a bottom.

8. The broom and dustpan combination of claim 7 wherein said front and rear walls each have a hole therein.

* * * * *